US006386110B1

(12) United States Patent
Landman et al.

(10) Patent No.: US 6,386,110 B1
(45) Date of Patent: May 14, 2002

(54) DEFORMING CHARGE ASSEMBLY AND METHOD OF MAKING SAME

(75) Inventors: Chaarles W. Landman, Callao; William H. Grigsby, Jr., Fredericksburg; Robert J. Gripshover; John W. Hannick, both of King George, all of VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 29 days.

(21) Appl. No.: 09/734,244

(22) Filed: Dec. 11, 2000

(51) Int. Cl.[7] ..... F42B 3/00; C06D 5/06

(52) U.S. Cl. ..... 102/331; 102/288; 102/289; 102/481

(58) Field of Search ..... 102/331, 481, 102/288, 289; 428/408

(56) References Cited

U.S. PATENT DOCUMENTS

| | | | | | |
|---|---|---|---|---|---|
| 3,194,158 | A | | 7/1965 | Paul | 102/10 |
| 3,992,997 | A | | 11/1976 | McCubbin et al. | 102/56 R |
| 4,084,512 | A | | 4/1978 | San Miguel | 102/103 |
| 4,485,721 | A | | 12/1984 | Shankhla et al. | 89/15 |
| 4,596,619 | A | * | 6/1986 | Marks | 102/287 X |
| 4,646,615 | A | | 3/1987 | Gladstone et al. | 89/15 |
| 4,655,866 | A | * | 4/1987 | Ferrier | 102/289 X |
| 5,035,180 | A | | 7/1991 | Purcell et al. | 102/481 |
| 5,170,007 | A | | 12/1992 | Figge, Sr. | 102/481 |
| 5,298,299 | A | * | 3/1994 | Shea | 428/34.5 |
| 5,369,955 | A | | 12/1994 | VanName et al. | 60/253 |
| 5,675,966 | A | * | 10/1997 | Dombrowski et al. | 60/204 |
| 5,700,573 | A | * | 12/1997 | McCullough | 428/364 |
| 5,750,058 | A | * | 5/1998 | Hecht et al. | 264/29.6 |
| 5,976,293 | A | * | 11/1999 | Olander et al. | 156/172 |
| 6,038,979 | A | * | 3/2000 | Watson et al. | 102/481 |
| 6,178,991 | B1 | * | 1/2001 | Schiwek | 137/351 |
| 6,179,944 | B1 | * | 1/2001 | Monolo et al. | 156/169 |
| 6,341,708 | B1 | * | 1/2002 | Palley et al. | 220/1.5 |

* cited by examiner

*Primary Examiner*—Peter A. Nelson
(74) *Attorney, Agent, or Firm*—James B. Bechtel, Esq.; James V. Tura, Esq.

(57) ABSTRACT

A deforming charge assembly is provided which has an inner and an outer cylinder formed from carbon fiber. Each of the inner and outer cylinders have an inner circumference surface having an inner diameter and an outer circumference surface having an outer diameter. The inner diameter of the outer cylinder is greater than the outer diameter of the inner cylinder. Each of the inner and outer cylinders have a first layer of circumferentially wound carbon fiber, a second layer of unidirectional carbon fiber sheet and a plurality of layers of carbon fibers circumferentially wrapped around the second layer. A plurality of sympathetic detonation barrier members are provided and have an inner surface in contact with the outer circumference surface of the inner cylinder and an outer surface in contact with the inner circumference surface of the outer cylinder.

16 Claims, 3 Drawing Sheets

FIG.1
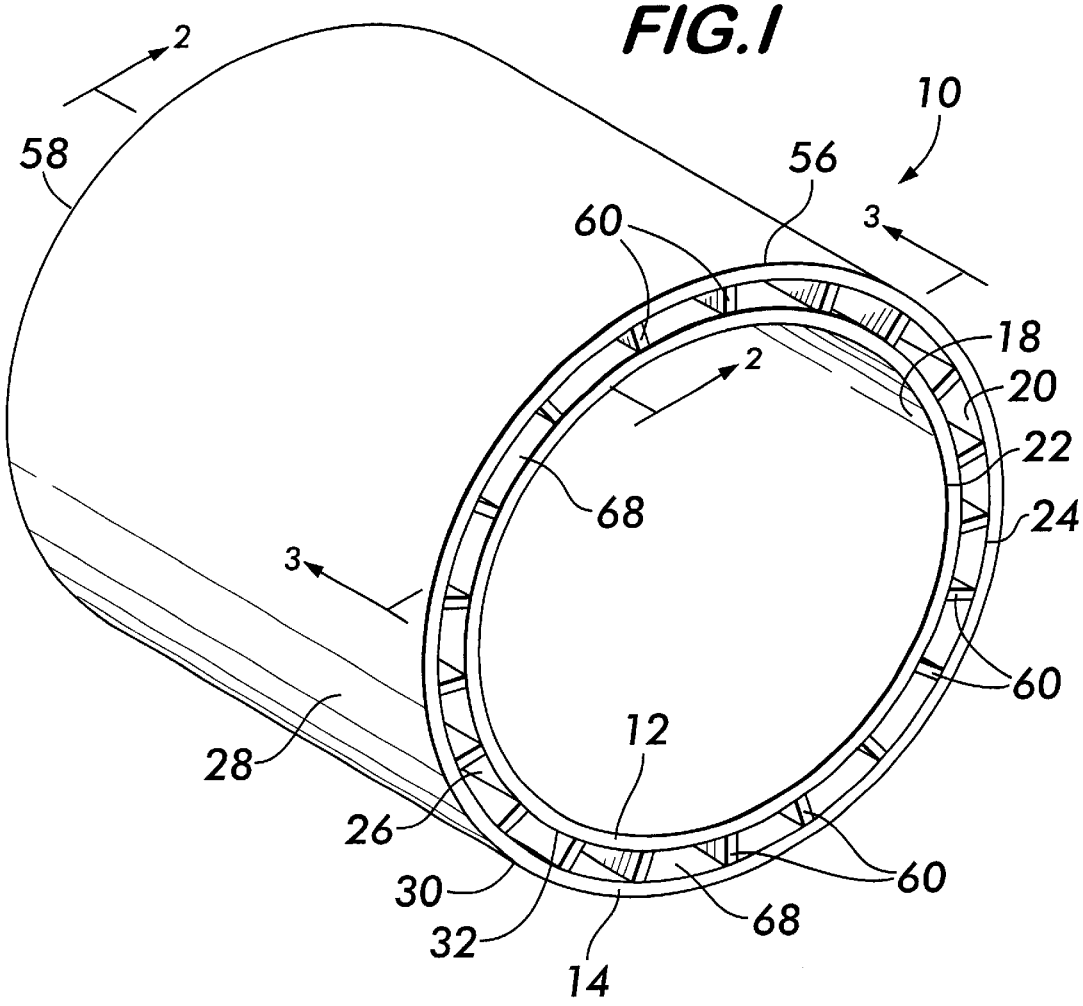
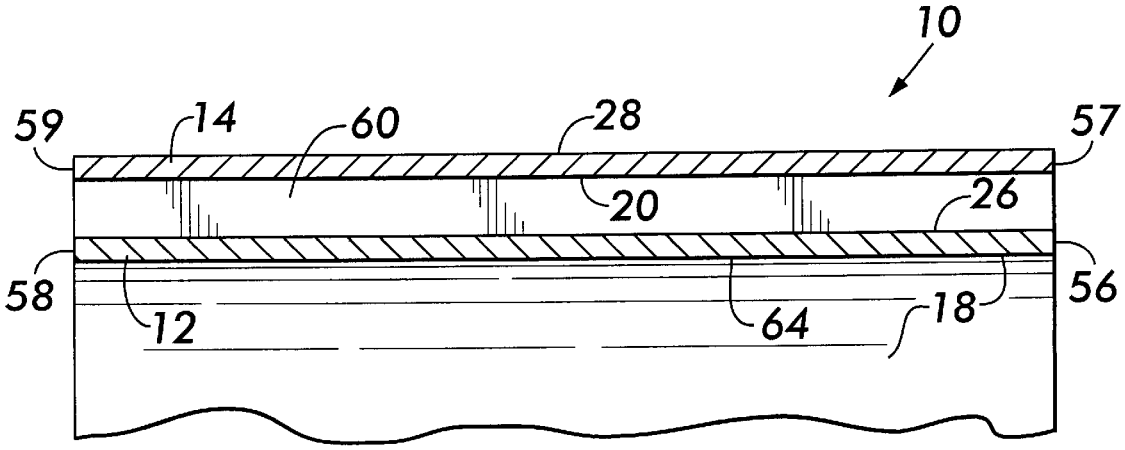
FIG.2

DEFORMING CHARGE ASSEMBLY AND METHOD OF MAKING SAME

STATEMENT OF GOVERNMENT INTEREST

The invention described herein may be manufactured and used by or for the Government of the United States of America for governmental purposes without the payment of any royalties thereon or therefor.

BACKGROUND OF INVENTION

The present invention relates to a deforming charge assembly and method of making same and more particularly to a deforming charge assembly which reduces the danger of explosion by the charge assembly.

Ordinance items such as loaded charge assemblies, for example those used in rocket motors, warheads and bombs, present an extreme hazard in the event of "cook off" which is defined for purposes of the subject application as detonation or deflagration of the main explosive charge of the item due to an accidental fire. The transportation and storage of charge assemblies, loaded with an explosive, frequently requires placing them in environments which have a high probability of being in the proximity of open flames. For example, loaded charge assemblies are frequently placed on the flight deck of a naval ship where an aircraft fuel tank is also present. If accidental rupture of the fuel tank occurs, fuel spreads over the flight deck. A fire that results upon ignition of the spilled fuel can subject the loaded charge assemblies to high temperatures along with a high risk of ignition of the explosive material in the charge assemblies. The rapid internal pressure buildup in the loaded charge assemblies will result in case rupture and explosion with catastrophic results, including costly equipment losses and potential loss of life.

Efforts have been made to modify charge assemblies to preclude explosive behavior of the charge assembly when loaded with an explosive material or to extend the time prior to violent reaction of the loaded charge assembly to a fire. It is desirable to provide an economical, reliable and tailorable charge assembly which provides the necessary structural integrity under normal conditions essential to its primary mission, while allowing structural degradation when the assembly reaches a predetermined abnormally elevated temperature which is below the auto ignition temperature of the explosive in the charge assembly. Such a charge assembly design renders the loaded charge assembly incapable of sustaining sufficient internal pressure to destructively detonate the charge assembly.

With the advent of plastic and other fibers, various materials have been used to form ordinance devices. For example, U.S. Pat. No. 2,872,865 discloses a woven fiber glass sleeving impregnated with plastic material. U.S. Pat. No. 5,369,955 shows a filament of polyolefin or polyethelene wound on a mandrel in a number of plies and impregnated with a matrix material curable by radiation. U.S. Pat. No. 5,170,007 discloses a sheet of material woven from a composite fiber reinforced thermoplastic, such as polyethersulfonegraphite fiber, rolled into a cylinder. An adhesive, having a breakdown temperature less than the autoignition temperature of the propellant in the cylinder, is used to hold the sheet in the cylindrical form and release before the propellant reaches its autoignition temperature.

U.S. Pat. No. 5,035,180 discloses an ordinance venting system having a number of holes in the ordinance casing covered by thermal metallic patches which expand at a different rate than the casing and open the vent holes when subjected to heat.

U.S. Pat. No. 3,992,997 shows an insulated warhead casing having a metallic tube surrounded by an ablative material such as cork, carbon or TEFLON and an outer fire resistant layer of glass fiber material impregnated with curable epoxy adhesive. U.S. Pat. No. 5,125,179 teaches a gun barrel formed from a ceramic material sections surrounded by an outer sleeve of braided graphite composition structure or a graphite fiber/epoxy composite wrapped about the ceramic sections. Other warhead designs used a graphite epoxy material, wound in a thin cylinder, to contain an explosive billet which is removed during depot maintenance of the missile.

U.S. Pat. No. 4,646,615 discloses a barrel section for a lightweight firearm manufactured by positioning epoxy treated carbon fibre rovings in grooves in a mandrel with an inner mandrel supporting the rovings which are at a slight helical angle to form the rifling of the barrel. The grooves have a slight narrowing towards the center of the barrel to facilitate removal of the grooved mandrel after formation of the barrel. A carbon fibre material treated with an epoxy resin is then wound around the mandrels and rovings in the desired angle and layers. Preferably the first four layers are hoop wound at a helix angle as close to 90 degrees as possible within the remaining layers wound according to a formula.

Deforming charge assemblies of the type provided by the present invention have been made with strips of relatively insensitive Dupont LF-2 Detasheet, separated by sympathetic detonation barriers, applied around the portion of the warhead circumference on the side to be deformed. In a system application, Detasheet would be placed around the entire warhead. The number of strips and barriers would be determined by the number of firing directions that a candidate system could support. The barrier would confine the detonation to those sectors specifically selected by the target detection device (TDD), and fired and initiated by the electronic safe arm device (ESAD) and the warhead initiation system (WIS).

Safety requirements dictated that an insensitive form of Detasheet be used in any tactical system. When the insensitive LF-2 Detasheet became unavailable, alternate designs using insensitive explosive as a means of deforming the warhead had to be devised. More sensitive Detasheet was available and could be used to complete development, but it was too sensitive for tactical applications. Also, when producibility and depot maintenance were considered, the use of discrete strips of Detasheet with barriers between them was not an acceptable design. Graphite-epoxy materials, wound in a thin cylinder, have been used to contain explosive billets which are removed during depot maintenance of the missile.

It is therefore an object to provide a deforming charge assembly loaded with an explosive that can be sized to duplicate the performance characteristics of Detasheet and which resolves the problems inherent with separate pieces of Detasheet and barriers. It is a further object to provide a deforming charge assembly that may be efficiently mass produced and that may be efficiently explosively loaded by the extrusion process. It is a further object to provide a graphite housing of the deforming charge assembly to aid in meeting Insensitive Munitions (IM) requirements.

SUMMARY OF THE PRESENT INVENTION

The present invention provides a deforming charge assembly which as an inner and an outer cylinder formed from carbon fiber. Each of the inner and outer cylinders have an inner circumference surface having an inner diameter, and an outer circumference surface having an outer diameter. The inner diameter of the outer cylinder is greater than the outer diameter of the inner cylinder. Each of the inner and outer cylinders have a first layer of circumferentially wound carbon fiber, a second layer of unidirectional carbon fiber sheet and a plurality of layers of carbon fibers circumferentially wrapped around the second layer. A plurality of sympathetic detonation barrier members are provided and have an inner surface in contact with the outer circumference surface of the inner cylinder and an outer surface in contact with the inner circumference surface of the outer cylinder which form a plurality of annular cavities.

The deforming charge assembly is formed by the method of circumferentially winding a carbon fiber around an inner mandrel to form a first layer of the inner cylinder, wrapping a unidirectional carbon sheet around the first layer of the inner cylinder to form a second layer of the inner cylinder, circumferentially winding a carbon fiber around the second layer of the inner cylinder to form a plurality of outer layers, coating the inner cylinder with epoxy resin. The outer mandrel is then positioned around the inner cylinder and in contact therewith. The outer mandrel has slots extending from one end of the outer mandrel towards the other end of the outer mandrel. Steel sympathetic detonation barrier strips and strips of TEFLON on each side of the barrier strip are positioned in each of the slots in the outer mandrel. The method then provides for circumferentially winding a carbon fiber around the outer mandrel to form a first layer of an outer cylinder, wrapping a unidirectional carbon sheet around the first layer of the outer cylinder to form a second layer of the outer cylinder, circumferentially winding a carbon fiber around the second layer of the outer cylinder to form a plurality of outer layers, coating the outer cylinder with epoxy resin, and removing the outer mandrel from between the inner and outer cylinders and the inner mandrel from the inner cylinder.

An explosive, such as PBXW-128, is injection loaded into the annular cavities and is sized to duplicate the performance characteristics of Detasheet which resolves the problems inherent with separate pieces of Detasheet and barriers. The present invention provides a deforming charge assembly which may be efficiently mass produced and that may be efficiently explosively loaded by the extrusion process. A deforming charge assembly is also provided by the present invention having a graphite housing which aids in meeting Insensitive Munitions (IM) requirements. In addition to light weight and strength, graphite material is electrically conductive, thereby eliminating the electrostatic hazard often associated with composites and explosives.

BRIEF DESCRIPTION OF THE DRAWINGS

FIG. 1 is a perspective view of the deforming charge assembly of the present invention, FIG. 2 is a partial sectional view of the deforming charge assembly shown in FIG. 1 and taken along line 2—2 thereof.

DETAILED DESCRIPTION OF THE IMVENTION

Figure 3:
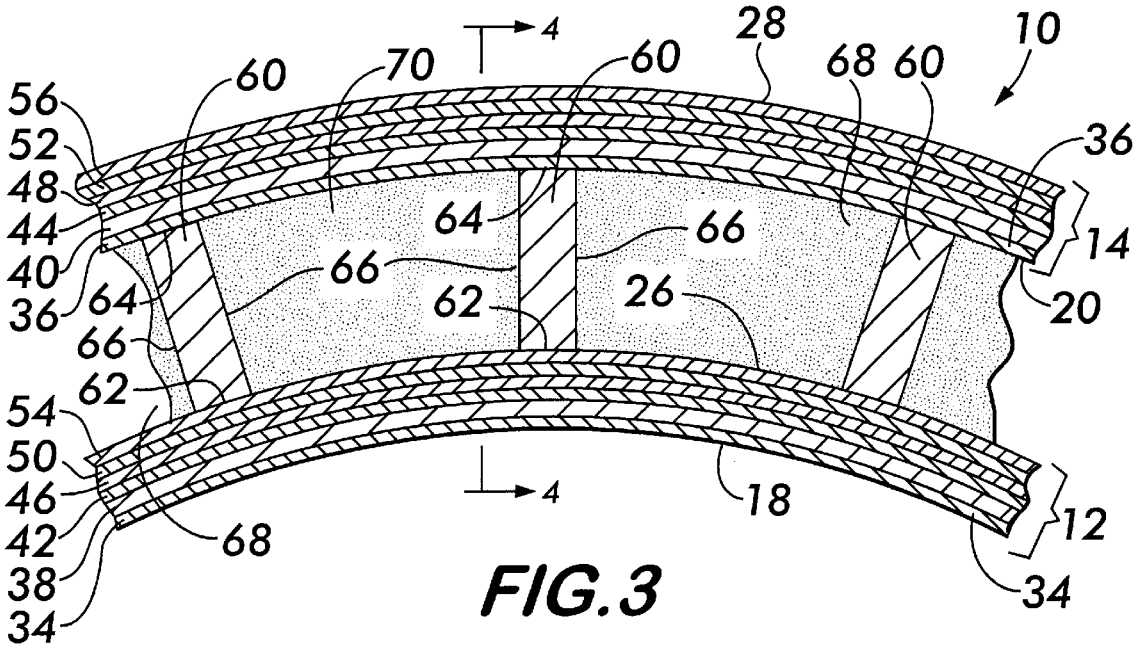
FIG. 3 is a partial sectional view of the deforming charge assembly shown in FIG. 1 and taken along line 3—3 thereof.

The present invention provides a deforming charge assembly 10 which has an inner and an outer cylinder 12, 14 respectively, formed from carbon fiber 16 as seen in FIGS. 1–4. Each of the inner and outer cylinders 12, 14 have an inner circumference surface 18, 20 respectively having an inner diameter 22, 24 respectively, an outer circumference surface 26, 28 respectively having an outer diameter 30, 32 respectively. The inner diameter 24 of the outer cylinder 14 is greater than the outer diameter 30 of the inner cylinder 12 and in a preferred design is about 0.57 inches greater.

Each of the inner and outer cylinders 12, 14 have a first layer 34, 36 respectively of circumferentially wound carbon fiber 16, a second layer of 38, 40 of unidirectional carbon fiber sheet and four outer layers 42, 44, 46, 48, 50, 52, and 54, 56 respectively of carbon fibers 16 circumferentially wrapped around the second layer 38, 40. The layers 34, 38, 42, 46, 50 and 54 extend between the ends 56, 58 of the inner cylinder 12 and the layers 36, 40, 44, 48, 52 and 56 extend between the ends 57, 59 of the outer cylinder 14. The carbon fiber 16 to form the cylinders 12, 14, is light weight, high strength, and is electrically conductive, thereby eliminating the electrostatic hazard often associated with composites and explosives. Preferably, the cylinders are made of an AS4 carbon fiber.

A plurality of sympathetic detonation barrier members 60 are provided and have a generally rectangular crossectional configuration and have an inner surface 62, an outer surface 64, and side surfaces 66. The inner surface 62 is in contact with the outer circumference surface 26 of the inner cylinder 12 and its outer surface 64 is in contact with the inner circumference surface 20 of the outer cylinder 14. A number of barrier members 60 are positioned around the space between the inner and outer cylinders 12, 14 as described above. The side surfaces 66 of adjacent barrier members 60, the outer circumference surface 26 of the inner cylinder 12 and the inner circumference surface 20 of the outer cylinder 14 between the adjacent barrier members form annular cavities or apertures 68 about the cylinders 12, 14. The annular cavities or apertures 68 are filled with an explosive 70 as will be more fully described. In a preferred design, the radial distance between the outer circumferential surface of the inner cylinder and the inner surface of the outer cylinder is about 0.285 inches.

The number of firing directions which could be supported by a system dictate the number of strips and barriers 60 which are used. Testing has been conducted to determine what material the sympathetic detonation barrier members 60 should be made of, and how much of it, had to be placed between the sectors of inner and outer cylinders 12, 14 so that one strip would not sympathetically detonate an adjacent one. The best material was determined to be the most dense, and tungsten emerged as the first choice, followed by lead and steel. Although barriers of tungsten or lead would be less thick than those made of steel, the cost and environmental effects of using either of those materials outweighed the savings. Therefore, steel was chosen for the barriers. In the preferred design, the sympathetic detonation barriers 60 are fabricated from 304 stainless steel, and are 0.125 inches thick, that is the distance between the side surfaces 66, which is a conservative design for the standard PBXW-128 explosive 70 with 77% HMX content used to load the annular cavities of apertures 68 about the cylinders 12, 14.

Figure 4:
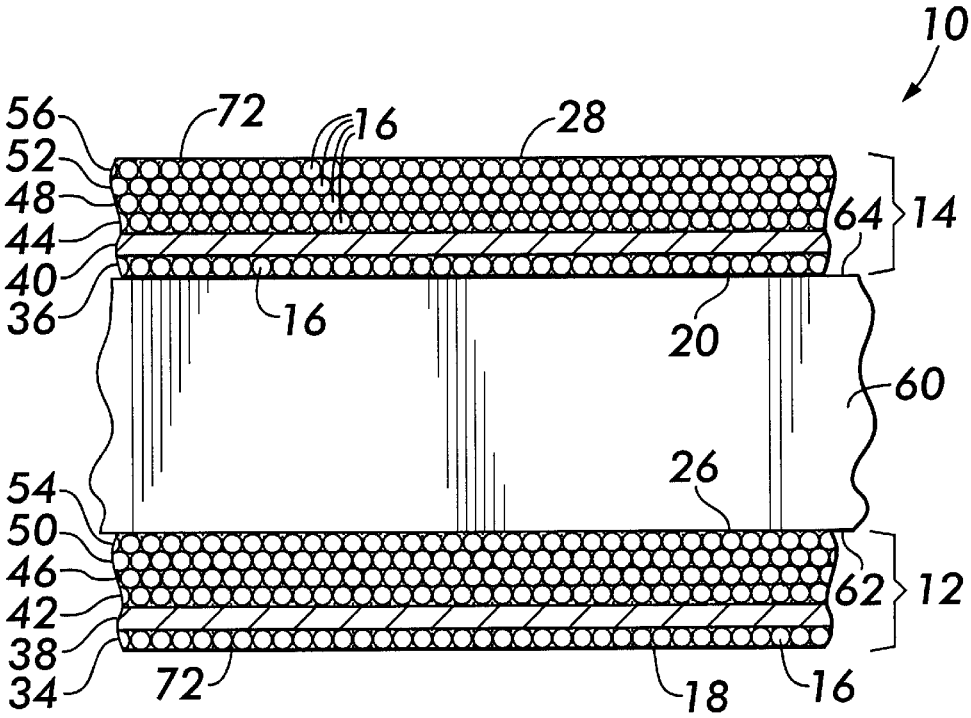
FIG. 4 is a partial sectional view of the deforming charge assembly shown in FIG. 3 and taken along line 4—4 thereof.
Figure 5:
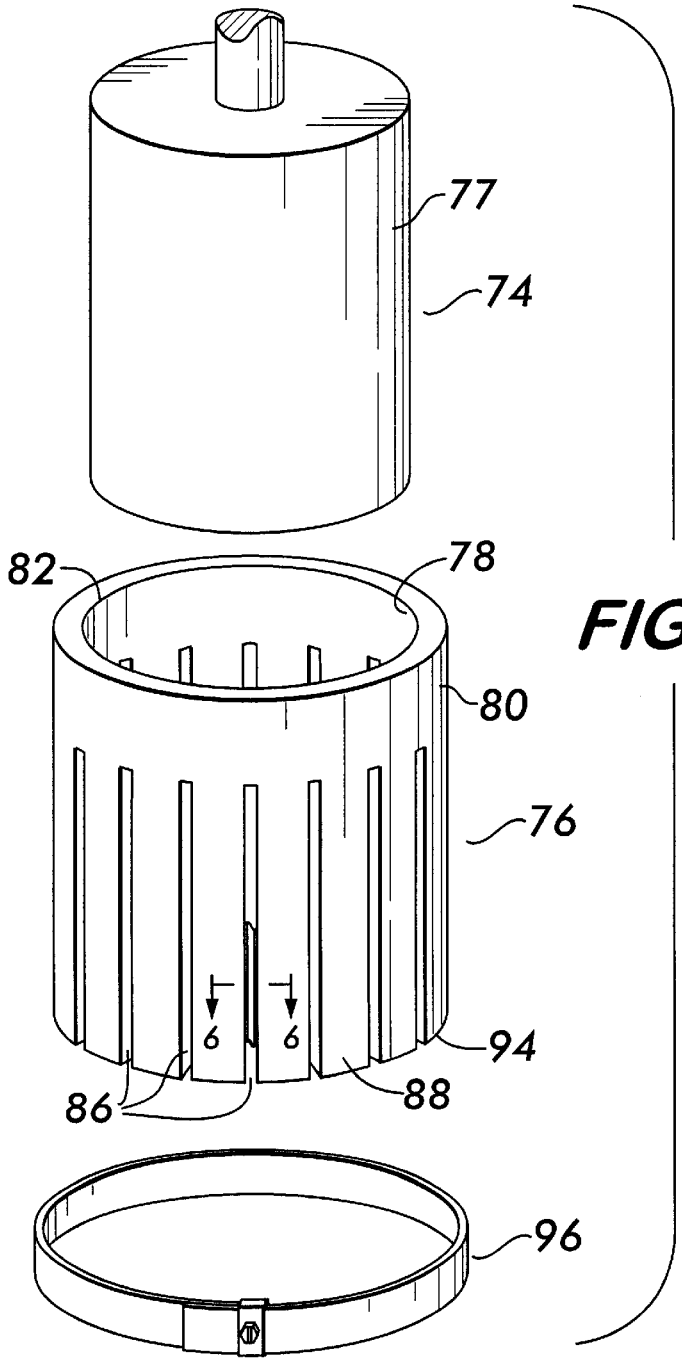
FIG. 5 is a perspective view of the inner and outer mandrels used to form the deforming charge assembly of the present invention and a hose clamp.
Figure 6:
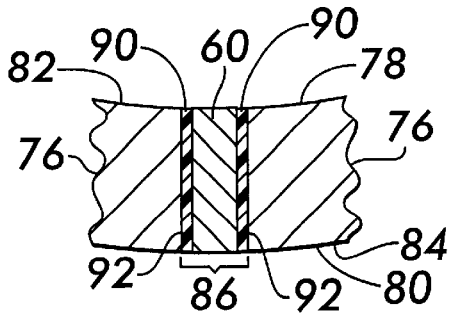
FIG. 6 is a partial sectional view of the outer mandrel shown in FIG. 5 with a sympathetic detonation barrier of the deforming charge assembly positioned therein.

The cylinders 12, 14 and the sympathetic detonation barrier members 60 are formed as a unitary structure with an epoxy 72, such as EPON 8132/Teta hardener epoxy system, binding the carbon fiber 16 and the unidirectional carbon fiber sheet 38, 40 forming the inner and outer cylinders 12, 14 respectively. The method of forming the inner and outer cylinders 12, 14 is described below and the use of the epoxy 72 is more fully described. The deforming charge assembly 10 of the present invention is formed with an inner and outer mandrel 74, 76 respectively, as shown in FIGS. 5 and 6. The inner cylinder 12 is manufactured first. To form the inner cylinder 12, the inner mandrel 74 is mounted on a winding machine such as and a four axis filament winding machine manufactured by Engineering Technology Co., Salt Lake City, Utah. The inner mandrel 74 has a generally cylindrical shape. The first layer 34 of the inner cylinder 12 is formed by circumferentially winding a carbon fiber 16, such as a dual carbon fiber wrap manufactured by Thornel, product number T300 6K, around the outer circumferential surface 77 of the inner mandrel 74 to form the first layer 34 as shown in FIG. 4.

The second layer 38 is formed by wrapping a unidirectional carbon sheet, such as that manufactured by Hexel, part No. S6565, around the first layer 34 of the inner cylinder 12 to form the second layer 38 of the inner cylinder and is provided for longitudinal strength of the inner cylinder 12. The third, fourth, fifth and sixth layers 42, 46, 50 and 54 respectively of the inner cylinder 12 are formed on the four axis filament winding machine by circumferentially wrapping the third layer 42 around the second layer 38, then circumferentially wrapping the fourth layer 46 around the third layer 42, then circumferentially wrapping the fifth layer 50 around the fourth layer 46 and then circumferentially wrapping the sixth layer 54 around the fifth layer 50.

The third through six layers, 42, 46, 50 and 54, sue the same T300 6K wrap as in the first layer 34, for a typical total thickness of the inner cylinder 12 of about 0.050 inches. The inner mandrel 74, carbon fiber wraps 34, 42, 46, 50 and 54, and the unidirectional sheet 38 are then liberally coated with epoxy resin 72, manufactured by Shell Oil Co., part no. EPON 8132 mixed with an appropriate curing agent such as Shell's Epi-Cure 3046.

The outer mandrel 76, as shown in FIGS. 5 and 6, and has a generally cylindrical shape with inner and outer circumferential surfaces 78, 80 respectively. The inner circumference 82 of the outer mandrel 76, and consequently the diameter of its inner surface 78 is equal to the circumference of the outer circumference 26 of the inner cylinder 12 and its diameter 30. The outer circumference 84 of the outer mandrel 76, and consequently the diameter of its outer surface 80 is equal to the circumference of the inner circumference 20 of the outer cylinder 14 and its diameter 24.

To position the sympathetic detonation barriers 60 between the inner and outer cylinders 12, 14, the outer mandrel 76 has a series of slots 86 about its periphery 88 and positioned therearound to position the sympathetic detonation barriers 60 where desired. As seen in FIGS. 5 and 6 plastic strips 90, such as TEFLON, are provided for allowing removal of the outer mandrel 76 after the deforming charge assembly 10 is formed as will be hereinafter described.

The outer mandrel 76 is positioned around the inner cylinder 12 with its inner circumferential surface 78 adjacent to the outer circumference 26 of the inner cylinder 12. The sympathetic detonation barriers 60 are then positioned in each of the slots 86 of the outer mandrel 76 with the plastic strips 90 positioned between the mandrel slot 86 and the sympathetic detonation barrier. Each of the slots 86 has opposing inner sides 92 which are spaced from each other a sufficient distance to receive a sympathetic detonation barrier 60 with a plastic strip 90 on each side of the barrier 60.

The entire assembly of the inner mandrel 74, inner cylinder 12, outer mandrel 76, sympathetic detonation barriers 60 and plastic strips 90 is bolted together on the wrapping machine. Prior to starting the manufacture of the outer cylinder 14, the outer end 94 of the outer mandrel 76 is encircled with a stainless steel aircraft type circular hose clamp 96 which contacts the steel sympathetic detonation barriers 60 and plastic strips 90 in the slots 86 and holds them in proper alignment. The hose clamp 96 is removed s the first carbon fiber wrap approaches the clamp.

The outer cylinder 14 is manufactured in the same manner as the inner cylinder 12, using the same products and winding machine. To form the outer cylinder 14, first layer 36 of the inner cylinder 14 is formed by circumferentially winding a carbon fiber 16, such as a dual carbon fiber wrap manufactured by Thornel, product number T300 6K, around the outer mandrel 76. The circular or hose clamp 96 is removed as the first carbon fiber 16 approaches the clamp.

The second layer 40 is formed by wrapping a unidirectional carbon sheet, such as that manufactured by Hexel, part No. S6565, around the first layer 36 of the outer cylinder 14 to form the second layer 40 of the outer cylinder and is provided for longitudinal strength of the outer cylinder 14. The third, fourth, fifth and sixth layers 44, 48, 52 and 56 respectively of the outer cylinder 14 are formed on the four axis filament winding machine by circumferentially wrapping the third layer 44 around the second layer 40, then circumferentially wrapping the fourth layer 48 around the third layer 44, then circumferentially wrapping the fifth layer 52 around the fourth layer 48 and then circumferentially wrapping the sixth layer 56 around the fifth layer 52.

The third through six layers 44, 48, 52 and 56, use the same T300 6K wrap as in the first layer 36, for a typical total thickness of the outer cylinder 14 of about 0.050 inches. The outer mandrel 76, carbon fiber wraps 36, 44, 48, 52 and 56, and the unidirectional sheet 40 are then liberally coated with epoxy resin, manufactured by Shell Oil Co., part no. EPON 8132 mixed with an appropriate curing agent such as Shell's Epi-Cure 3046.

After wrapping, the assembly is allowed to rotate slowly to prevent the resin from sloughing off the cylinders 12, 14 until it gels. The entire assembly is removed from the winding machine and placed in an oven at a temperature and for a sufficient time for the epoxy to cure. Using the preferred materials described herein, the assembly 10 is placed in an oven for four hours at 212° F. temperature to cure. After the epoxy resin is cured, the assembly 10 is then allowed to cool to ambient (room) temperature for the remainder of the day and over night.

The mandrels 74, 76 and then using a specially made fixture, since the force required is usually very large. This is an important step, since the deforming charge assembly 10 can be destroyed by the force required for removing the mandrels. Finally, the plastic strips 90 are removed by hand using a screw driver as a probe and the ends 56, 58 of the inner cylinder 12, the ends 57, 59 of the outer cylinder 14, and the sympathetic detonation barriers 60 of the assembly 10 are dressed by hand, using emery cloth and a sanding block. The deforming charge assembly 10 is then injection loaded with PBXW-128 explosive. When ready to use the deforming charge assembly 10, detonators, such as RP-80 detonators, are installed.

The invention has been described with reference to the preferred embodiments. Obviously, modifications and alterations will occur to others upon reading and understanding this specification. It is intended to include all modifications and alterations insofar as they come within the scope of the appended claims or equivalents thereof The invention claimed:

1. A deforming charge assembly comprising an inner and an outer cylinder formed from carbon fiber, each of said inner and outer cylinders having an inner circumferential surface having an inner diameter and that outer circumferential surface having an outer diameter, said inner diameter of said outer cylinder is greater than said outer diameter of said inner cylinder, each of said inner and outer cylinders having a first layer of circumferentially wound carbon fiber, a second layer of unidirectional carbon fiber sheet and a plurality of layers of carbon fibers circumferentially wrapped around said second layer, a plurality of sympathetic detonation barrier members having an inner surface in contact with said outer circumferential surface of said inner cylinder, said barrier members having an outer surface in contact with said inner circumferential surface of said outer cylinder.

2. The deforming charge assembly of claim 1 wherein said sympathetic detonation barrier members are formed from 304 stainless-steel.

3. The deforming charge assembly of claim 1 wherein said sympathetic detonation barrier members are about 0.125 inches thick.

4. The deforming charge assembly of claim 1 wherein at least one of said inner and outer cylinders have a wall thickness of about 0.05 inches.

5. The deforming charge assembly of claim 1 wherein the difference between said outer diameter of said inner cylinder and said inner diameter of said outer cylinder is about 0.285 inches.

6. The deforming charge assembly of claim 1 wherein said barrier members adjacent each other and said outer circumferential surface of said inner cylinder extending between said adjacent barrier members and said inner circumferential surface of said outer cylinder extending between said adjacent barrier members forming an annular cavity.

7. The deforming charge assembly of claim 6 which includes an explosive in said annular cavity.

8. A method for making a deforming charge assembly comprising the steps of:

circumferentially winding a carbon fiber around an inner mandrel to form a first layer of an inner cylinder, wrapping a unidirectional carbon sheet around the first layer of the inner cylinder to form a second layer of the inner cylinder, circumferentially winding a carbon fiber around the second layer of the inner cylinder to form a plurality of outer layers, coating the inner cylinder with epoxy resin, positioning an outer mandrel around the inner cylinder and in contact therewith, which outer mandrel has slots extending from one end of the outer mandrel towards the other end of the outer mandrel, positioning a steel sympathetic detonation barrier strip and strips of plastic on each side of the barrier strip in each of the slots in the outer mandrel, circumferentially winding a carbon fiber around the outer mandrel to form a first layer of an outer cylinder, wrapping a unidirectional carbon sheet around the first layer of the outer cylinder to form a second layer of the outer cylinder, circumferentially winding a carbon fiber around the second layer of the outer cylinder to form a plurality of outer layers, coating the outer cylinder with epoxy resin, removing the outer mandrel from between the inner and outer cylinders and the inner mandrel from the inner cylinder.

9. The method for making the deforming charge assembly of claim 8 which includes securing a circular clamp around the outer mandrel and in contact with the steel sympathetic detonation barrier strips and the strips of plastic in the slots of the outer mandrel after the step of positioning the barrier strips and strips of plastic in the slots in the outer mandrel.

10. The method for making the deforming charge assembly of claim 9 which includes removing the circular clamp during circumferentially winding the carbon fiber around the outer mandrel as the first carbon fiber approaches the clamp.

11. The method for making the deforming charge assembly of claim 8 which includes heating the inner and outer cylinders to cure the epoxy resin after coating the outer cylinder with epoxy resin.

12. The method for making the deforming charge assembly of claim 8 which includes removing the plastic strips after removing the outer mandrel from between the inner and outer cylinders in the inner mandrel from the inner cylinder.

13. The method for making the deforming charge assembly of claim 12 which includes securing the ends of the deforming charge assembly after removing the plastic strips.

14. The method for making the deforming charge assembly of claim 8 which includes extruding an explosive between the inner and outer cylinders after removing the outer mandrel from between the inner and outer cylinders and the inner mandrel from the inner cylinder.

15. The method for making the deforming charge assembly of claim 8 which includes rotating the deforming charge assembly after removing the outer mandrel from between the inner and outer cylinders and the inner mandrel from the inner cylinder.

16. The method for making the deforming charge assembly of claim 8 which includes heating the deforming charge assembly after removing the outer mandrel from between the inner and outer cylinders and the inner mandrel from the inner cylinder.

* * * * *